US012264552B1

(12) United States Patent
Wang et al.

(10) Patent No.: US 12,264,552 B1
(45) Date of Patent: Apr. 1, 2025

(54) ALL-METAL BRIDGE PLUG WITH SELF-CONTAINED BALL ADAPTED TO CASINGS WITH VARIOUS SPECIFICATIONS

(71) Applicant: CHONGQING YUHUA NEW MATERIALS TECHNOLOGY CO., LTD., Chongqing (CN)

(72) Inventors: Xiaohua Wang, Chongqing (CN); Tingji Tang, Chongqing (CN)

(73) Assignee: CHONGQING YUHUA NEW MATERIALS TECHNOLOGY CO., LTD., Chongqing (CN)

( * ) Notice: Subject to any disclaimer, the term of this patent is extended or adjusted under 35 U.S.C. 154(b) by 0 days.

(21) Appl. No.: 18/646,675

(22) Filed: Apr. 25, 2024

(30) Foreign Application Priority Data

Jan. 26, 2024 (CN) ..... 202410108132.X

(51) Int. Cl.
*E21B 33/134* (2006.01)
*E21B 33/128* (2006.01)
*E21B 43/26* (2006.01)

(52) U.S. Cl.
CPC ..... *E21B 33/134* (2013.01); *E21B 43/26* (2013.01)

(58) Field of Classification Search
CPC ..... E21B 43/26; E21B 33/134; E21B 33/128; E21B 33/12; E21B 33/1285; E21B 33/129; E21B 23/00
(Continued)

(56) References Cited

U.S. PATENT DOCUMENTS 2,249,172 A * 7/1941 Quintrell ..... E21B 33/12 166/125
3,332,497 A * 7/1967 Page, Jr. ..... E21B 34/105 137/496

(Continued)

FOREIGN PATENT DOCUMENTS

AU 2005225147 A1 12/2005
CN 105888606 A 8/2016

(Continued)

OTHER PUBLICATIONS

Tian, Yu, New progress of gas reservoir production increase technology abroad, World Petroleum Industry, 26(3): 37-43, 2019.

(Continued)

*Primary Examiner* — Kenneth L Thompson
(74) *Attorney, Agent, or Firm* — Porus IP LLC

(57) ABSTRACT

An all-metal bridge plug with a self-contained ball adapted to casings with various specifications, including a locking cap, an upper cone, a sealing ball, a metal sealing ring, a locking joint, a lower cone, a slip spider, a base, and a pull rod. One end of the pull rod may be connected with a seating tool, and the other end of the pull rod may be connected with the base through a first outer thread. The locking cap, the upper cone, the locking joint, the lower cone, and the slip spider may be sleeved on the pull rod sequentially from left to right along an axial direction of the pull rod. The upper cone, the sealing ball, the metal sealing ring, the locking joint, the lower cone, the slip spider, and the base may be manufactured from magnesium-based and aluminum-based dissolvable metal materials that dissolve automatically after fracture is completed.

1 Claim, 10 Drawing Sheets

(58) Field of Classification Search
USPC ..... 166/376
See application file for complete search history.

(56) References Cited

U.S. PATENT DOCUMENTS

| | | | | |
|---|---|---|---|---|
| 11,933,132 | B1 * | 3/2024 | Shkurti | E21B 33/134 |
| 2011/0147015 | A1 | 6/2011 | Mickey et al. | |
| 2020/0072021 | A1 | 3/2020 | Zhao | |
| 2020/0149368 | A1 * | 5/2020 | Yoshida | E21B 23/06 |
| 2020/0347694 | A1 | 11/2020 | Power et al. | |
| 2023/0258051 | A1 * | 8/2023 | Eaton | E21B 23/00 166/376 |

FOREIGN PATENT DOCUMENTS

| | | | |
|---|---|---|---|
| CN | 106437615 | A | 2/2017 |
| CN | 109577910 | B | 5/2021 |
| CN | 116357265 | A | 6/2023 |
| CN | 116575884 | A | 8/2023 |
| CN | 219754505 | U | 9/2023 |
| CN | 117432364 | A | 1/2024 |
| WO | 2023097570 | A1 | 6/2023 |

OTHER PUBLICATIONS

First Office Action in Chinese Application No. 202410108132.X mailed on May 24, 2024, 12 pages.
Notification to Grant Patent Right for Invention in Chinese Application No. 202410108132.X mailed on May 30, 2024, 4 pages.

* cited by examiner

ALL-METAL BRIDGE PLUG WITH SELF-CONTAINED BALL ADAPTED TO CASINGS WITH VARIOUS SPECIFICATIONS

CROSS-REFERENCE TO RELATED APPLICATION

This application claims priority to Chinese application No. 202410108132.X filed on Jan. 26, 2024, the entire contents of which are incorporated herein by reference.

TECHNICAL FIELD

The present disclosure relates to a technical field of oil and gas field development, and in particularly to an all-metal bridge plug with a self-contained ball adapted to casings with various specifications.

BACKGROUND

In the development of oil and gas fields, fracturing operations on subsurface rocks may be often required to increase oil and gas production. Compared with traditional fracturing technology, a bridge-plug segmental fracturing technique may adopt a joint technology of perforation and bridge plug setting, or the like, which is able to more precisely control an injection position and a fracturing strength of a fracturing fluid, thereby increasing a recovery rate. Therefore, the bridge-plug segmental fracturing technology may be widely used in an oil and gas extraction field. When fracturing the oil or gas reservoir using the bridge-plug segmental fracturing technique, a sealing ball may be required to seal a center channel of the bridge plug. When placing the ball, the injection of the fracturing fluid may be stopped, and after the sealing ball arrives at and seals the center channel of the bridge plug, the fracturing operation may continue. In order to ensure a stability and a sealing effect of the bridge plug in a wellbore, the bridge plug may usually adopt a sealing ring and a slip anchoring at the same time. The design may require an accurate matching of the sealing ring and the slip, which has a very strict requirement for an inner diameter of a casing. Therefore, when utilizing the bridge plug segmental fracturing technique for the fracturing operation, all-metal bridge plugs of different specifications may usually be equipped for different sizes of casings, which is more costly.

Therefore, it is desired to provide an all-metal bridge plug with a self-contained ball adapted to casings with various specifications. By adapting a variety of different sizes of casings with a single size of the all-metal bridge plug, a cost may be reduced. Additionally, a structural design of the self-contained sealing ball may save a step of putting the sealing ball into the wellhead, improve a construction efficiency, and after the bridge plug is set, a setting situation of the bridge plug may be verified immediately, which improves the reliability of the bridge plug construction.

SUMMARY

One or more embodiments of the present disclosure provide an all-metal bridge plug with a self-contained ball adapted to casings with various specifications, including a locking cap, an upper cone, a sealing ball, a metal sealing ring, a locking joint, a lower cone, a slip spider, a base, and a pull rod. One end of the pull rod may be connected with a seating tool, and the other end of the pull rod may be connected with the base through a first outer thread. The locking cap, the upper cone, the locking joint, the lower cone, and the slip spider may be sleeved on the pull rod sequentially from left to right along an axial direction of the pull rod.

The upper cone, the sealing ball, the metal sealing ring, the locking joint, the lower cone, the slip spider, and the base may be manufactured from magnesium-based and aluminum-based dissolvable metal materials that dissolve automatically after a fracture is completed.

The upper cone may include an upper end portion and a lower end portion. An outer surface of the upper end portion may be a first outer cylindrical surface. The upper end portion may be provided with a first inner conical hole, a first inner circular hole, and a second inner circular hole sequentially from left to right along the axial direction of the pull rod. A circular hole structure may be provided between the first outer cylindrical surface and the second inner circular hole, and the sealing ball may be clamped between the pull rod and the circular hole structure. An outer surface of the lower end portion may be a first outer conical surface, and the lower end portion may be provided with a second inner conical hole, a third inner circular hole, and a first inner thread sequentially from left to right along an axial direction of the pull rod. The first inner conical hole may be sleeved on the locking cap.

An outer surface of the metal sealing ring may be a cylindrical surface. The metal sealing ring may be provided with a conical hole and a circular hole sequentially from left to right along the axial direction of the pull rod. The conical hole may have an inner conical surface sleeved on the first outer conical surface of the upper cone. The inner conical surface and the first outer conical surface may have the same cone angle and the two conical surfaces may be fitted with each other. One end of the cylindrical surface near the locking cap may be provided with a plurality of first grooves.

The locking joint may be provided with a second outer thread on an outer surface of the locking joint, the second outer thread being connected with the first inner thread of the upper cone. The locking joint may be provided with a first inner hole along the axial direction of the pull rod, an inner surface of the first inner hole being provided with a second groove.

An outer surface of the lower cone may be provided with a boss structure, a second outer cylindrical surface, and a second outer conical surface sequentially from left to right along the axial direction of the pull rod. The boss structure may abut against one end of the metal sealing ring away from the locking cap, and the second outer conical surface may be clamped within the slip spider. The lower cone may be provided with a second inner hole along the axial direction of the pull rod. The second hole may be provided with a second inner thread on an inner surface of the second inner hole. The second inner thread may be connected with the second outer thread of the locking joint.

The slip spider may be provided with a conical hole along the axial direction of the pull rod at an end near the locking cap. The slip spider may be sleeved on the second outer conical surface of the lower cone, and the inner surface of the conical hole may be fitted to the second outer conical surface of the lower cone. The slip spider may be provided with a plurality of grooves uniformly disposed in a circumferential direction along an outer surface of the slip spider at an end away from the locking cap.

The base may be provided with a boss at one end near the locking cap, the boss being clamped with the grooves of the slip spider. The base may be provided with a through hole along the axial direction of the pull rod, the through hole being provided with a third inner thread on an inner surface of the through hole. The third inner thread may be connected with the first outer thread of the pull rod.

BRIEF DESCRIPTION OF THE DRAWINGS

The present disclosure will be further illustrated by way of exemplary embodiments, which will be described in detail by means of the accompanying drawings. These embodiments are not limiting, and in these embodiments, the same numbering denotes the same structure, wherein.

Figure 1:
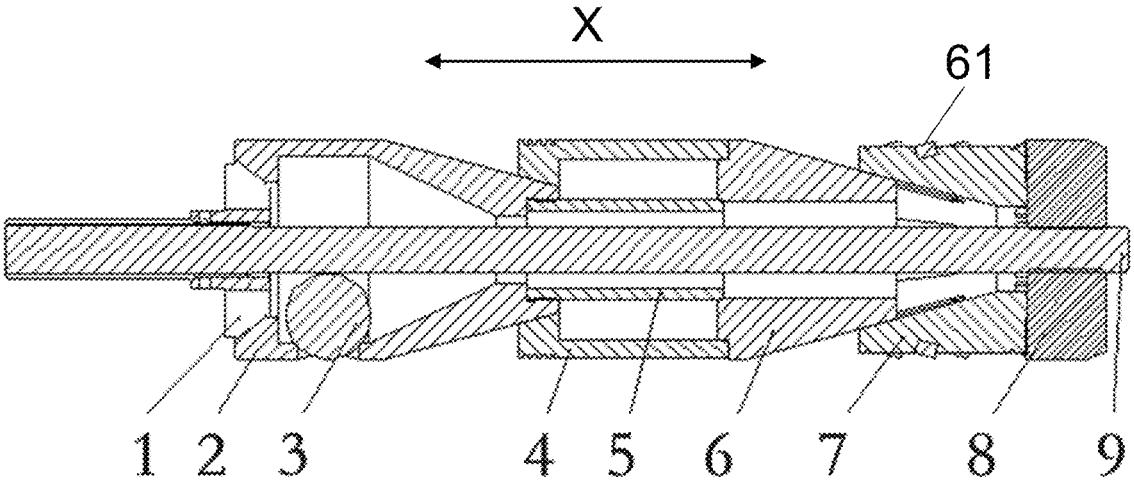
FIG. 1 is a schematic diagram illustrating an exemplary structure of an all-metal bridge plug with a self-contained ball adapted to casings with various specifications according to some embodiments of the present disclosure.

In the figures: 1, locking cap, 2, upper cone, 3, sealing ball, 4, metal sealing ring, 5, locking joint, 6, lower cone, 7, slip spider, 8, base, 9, a pull rod, 11, first inner conical hole, 12, first inner circular hole, 13, second inner circular hole, 14, second inner conical hole, 15, third inner circular hole, 16, first outer cylindrical surface, 17, first outer conical surface, 18, first inner thread, 19, circular hole structure, 21, second outer thread, 22, first inner hole, 23, second groove, 31, inner conical surface, 32, cylindrical surface, 33, circular hole, 34, first groove, 41, second outer cylindrical surface, 42, boss structure, 43, second outer conical surface, 44, second inner thread, 51, first casing, 52, second casing, 53, third casing, 61, anchor tooth.

DETAILED DESCRIPTION

In order to more clearly illustrate the technical solutions of the embodiments of the present disclosure, the following will briefly describe the accompanying drawings to be used in the description of the embodiments. Obviously, the accompanying drawings in the following description are only some examples or embodiments of the present disclosure, and it is possible for those skilled in the art to apply the present disclosure to other similar scenarios in accordance with these drawings without creative labor. The present disclosure may be applied to other similar scenarios based on these drawings without creative labor. Unless obviously obtained from the context or the context illustrates otherwise, the same numeral in the drawings refers to the same structure or operation.

It should be understood that the terms "system," "device," "unit," and/or "module" as used herein is a way to distinguish between different components, elements, parts, sections, or assemblies at different levels. However, the words may be replaced by other expressions if other words accomplish the same purpose.

As shown in the present disclosure and the claims, unless the context clearly suggests an exception, the words "a," "an," "one," and/or "the" do not refer specifically to the singular, but may also include the plural. Generally, the terms "including" and "comprising" suggest only the inclusion of clearly identified steps and elements. In general, the terms "including" and "comprising" only suggest the inclusion of explicitly identified steps and elements that do not constitute an exclusive list, and the method or apparatus may also include other steps or elements.

FIG. 1 is a schematic diagram illustrating an exemplary structure of an all-metal bridge plug with a self-contained ball adapted to casings with various specifications according to some embodiments of the present disclosure. As shown in FIG. 1, the all-metal bridge plug with a self-contained ball adapted to casings with various specifications (hereinafter referred to as the bridge plug) may include a locking cap 1, a upper cone 2, a sealing ball 3, a metal sealing ring 4, a locking joint 5, a lower cone 6, a slip spider 7, a base 8, and a pull rod 9. The locking cap 1 and the pull rod 9 may be metallic. The upper cone 2, the sealing ball 3, the metal sealing ring 4, the locking joint 5, the lower cone 6, the slip spider 7, and the base 8 may all be made of magnesium and aluminum-based dissolvable metal materials, which dissolve automatically after a fracturing is completed.

The pull rod 9 may be a rod-like structure located in a center of the bridge plug. In some embodiments, one end of the pull rod 9 may be coupled to a seating tool, the other end of the pull rod 9 may be coupled to the base 8 by a first outer thread, and the locking cap 1, the upper cone 2, the locking joint 5, the lower cone 6, and the slip spider 7 may be located along an axial direction of the pull rod 9 and may be sleeved on the pull rod 9 sequentially from left to right. The seating tool refers to a device or apparatus to be used in seating the bridge plug. For example, the seating tool may include a driving device, a perforating gun, or the like. In some embodiments, one end of the seating tool may be coupled to a cable, and when the bridge plug seating is complete, the seating tool, the locking cap 1, and the pull rod 9 may be raised out of an oil and gas well by lifting up the cable. In some embodiments, the seating tool may be connected with the pull rod 9 in a variety of ways. Exemplary connection manners may include a threaded connections, a snap connection, or the like. The first outer thread refers to a threaded structure provided on an outer surface of one end of the pull rod 9. In some embodiments, the axial direction of the pull rod 9 may be represented by the X direction indicated by the arrow in FIG. 1.

The locking cap 1 refers to an element for limiting the positions of other components sleeved on the pull rod 9 at one end (e.g. an upper end) along the axial direction of the pull rod 9. In some embodiments, the locking cap 1 may be sleeved on the upper end of the pull rod 9, and the locking cap 1 may be connected with the upper end of the pull rod 9 by threaded connection, weld, etc. to limit the positions of the other components sleeved on the pull rod 9 (e.g., the upper cone 2, the metal sealing ring 4, etc.) on the upper end of the pull rod 9 along the axial direction. The upper end may be understood to be the end near the seating tool.

Figure 2:
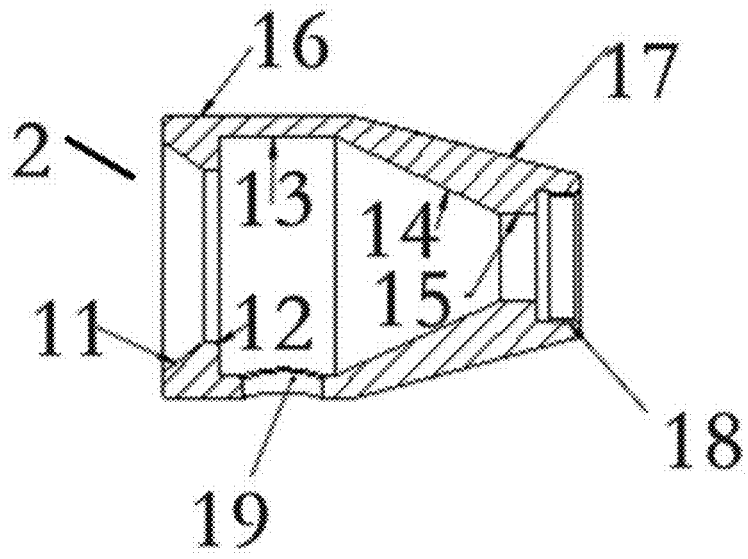
FIG. 2 is a schematic diagram illustrating an exemplary structure of an upper cone according to some embodiments of the present disclosure.

FIG. 2 is a schematic diagram illustrating an exemplary structure of an upper cone according to some embodiments of the present disclosure. As shown in FIG. 2, the upper cone 2 may be a cylindrical structure. The upper cone 2 may include an upper end portion and a lower end portion, an outer surface of the upper end portion being a first outer cylindrical surface 16. The upper end portion may be provided with a first inner conical hole 11, a first inner circular hole 12, and a second inner circular hole 13 sequentially from left to right along the axial direction of the pull rod 9. A circular hole structure 19 may be provided between the first outer cylindrical surface 16 and the second inner circular hole 13, and the sealing ball 3 may be snap-fitted between the pull rod 9 and the circular hole structure 19. The outer surface of the lower end portion may be a first outer conical surface 17, the lower end portion being provided with a second inner conical hole 14, a third inner circular hole 15, and a first inner thread 18 sequentially from left to right along the axial direction of the pull rod 9, and the first inner conical hole 11 may be sleeved on the locking cap 1. A dimension (e.g. a diameter) of the circular hole structure 19 may be smaller than a dimension of the sealing ball 3 to snap the sealing ball 3.

The sealing ball 3 may be a sphere capable of sealing a center channel of a bridge plug under an action of fluid flow when the sealing ball 3 seats the bridge plug. In some embodiments, the dimension of the third inner circular hole 15 may also be smaller than the dimension of the sealing ball 3 to ensure that the sealing ball 3 is able to seat the bridge plug center channel.

Figure 3:
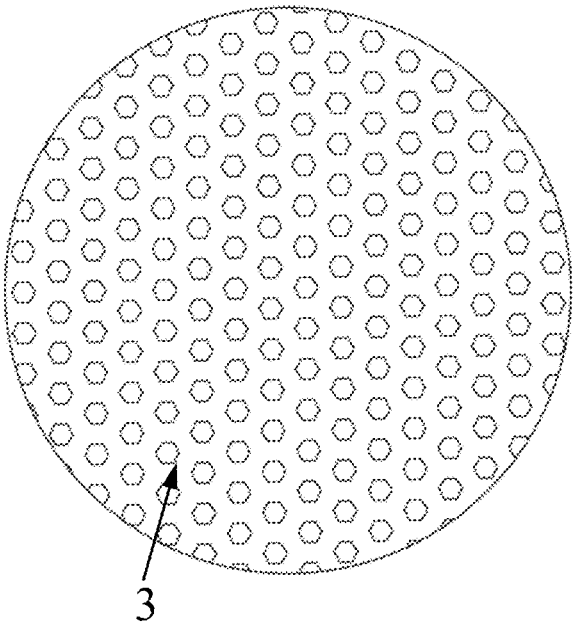
FIG. 3 is a schematic diagram illustrating an exemplary structure of a sealing ball according to some embodiments of the present disclosure.

FIG. 3 is a schematic diagram illustrating an exemplary structure of a sealing ball according to some embodiments of the present disclosure. As shown in FIG. 3, a surface of the sealing ball 3 may have a textured structure. The textured structure may be a tiny bump or other shaped feature formed on the surface of the sealing ball 3, such as a micro-porous structure, or bumpy small particles on the surface of the sealing ball 3. Understandably, the textured structure of the surface of the sealing ball 3 may help to increase a friction when contacting an inner wall of an upper cone (e.g., a side wall of the third inner circular hole 15), preventing the sealing ball 3 from sliding or rotating on the inner wall of the upper cone to better maintain a sealing state. In addition, a relative movement between the sealing ball 3 and the inner wall of the upper cone may lead to wear and tear, and the textured structure may increase a contact area between the sealing ball 3 and the inner wall of the upper cone, reduce a concentration of local pressure points, and may effectively slow down a rate of wear, thereby extending a service life of the sealing ball 3.

It should be noted that the sealing ball 3 may also be designed in any other feasible shape, as long as it is able to seal the center channel. For example, the sealing ball 3 may also be an ellipsoid, or the like.

Figure 4:
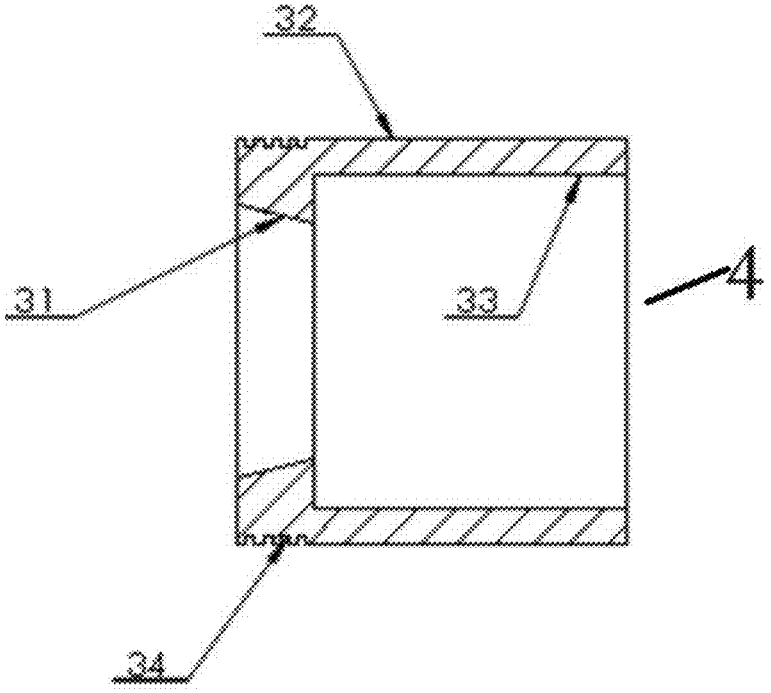
FIG. 4 is a schematic diagram illustrating an exemplary structure of a metal sealing ring according to some embodiments of the present disclosure.

The metal sealing ring 4 refers to an element for sealing an annular space between the upper cone 2 and a casing. FIG. 4 is a schematic diagram illustrating an exemplary structure of a metal sealing ring according to some embodiments of the present disclosure. As shown in FIG. 4, the metal sealing ring 4 may be a cylindrical structure, an outer surface of the metal sealing ring 4 being a cylindrical surface 32. The metal sealing ring 4 may be provided with a conical hole and a circular hole 33 sequentially from left to right along the axial direction of the pull rod 9. The conical hole may have an inner conical surface 31 sleeved on the first outer conical surface 17 of the upper cone 2. The inner conical surface 31 and the first outer conical surface 17 may have a same cone angle and the two conical surfaces may be fitted with each other. In some embodiments, one end of the cylindrical surface 32 close to the locking cap 1 may be provided with a plurality of first grooves 34.

When the bridge plug is sealed, the upper cone 2 and the metal sealing ring 4 may generate a relative movement, and the metal sealing ring 4 may climb upward along the first outer conical surface 17 of the upper cone 2, and an outer diameter of the metal sealing ring 4 may continuously expand outward. When the metal sealing ring 4 climbs to a certain position on the first outer conical surface 17, the outer diameter of the metal sealing ring 4 may enlarge to be the same as the inner diameter of a casing of a certain specification, and under an action of a seating force provided by seating tool, the metal sealing ring 4 may tightly abut an inner wall of the casing, thereby sealing the annular space between the casing and the upper cone 2.

In some embodiments, as the first outer conical surface 17 of the upper cone 2 has a certain length, the outer diameter of the metal sealing ring 4 may expand when the metal sealing ring 4 climbs along the first outer conical surface 17, and each position corresponds to the outer diameter of one metal sealing ring 4, enabling the sealing effect to be provided for different inner diameters of the casing.

The plurality of the first grooves 34 may increase the friction when the metal sealing ring 4 is in contact with the inner wall of the casing to further ensure the sealing effect of the metal sealing ring 4. In some embodiments, the dimensions of the plurality of the first grooves 34 may be the same or different.

In some embodiments, the metal sealing ring 4 may be coated, and a material of a coating may include at least one of a carbon-fiber-reinforced polymer and fluoroelastomer. In some embodiments, both the inner and the outer surfaces of the metal sealing ring 4 may be coated, or only the inner or the outer surface of the metal sealing ring 4 may be coated. In some embodiments, the material of the coating may also include polyetheretherketone, or the like. Understandably, the coating may provide protection for the metal sealing ring 4, and may improve a wear resistance and a corrosion resistance of the bridge plug while ensuring the sealing effect of the metal sealing ring 4, thereby extending a service life of the metal sealing ring 4.

Figure 5:
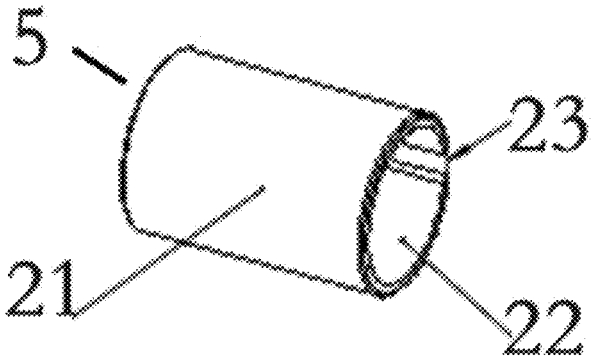
FIG. 5 is a schematic diagram illustrating an exemplary structure of a locking joint according to some embodiments of the present disclosure.

The locking joint 5 refers to an element for connecting and locking the upper cone 2 to the lower cone 6. FIG. 5 is a schematic diagram illustrating an exemplary structure of a locking joint according to some embodiments of the present disclosure. As shown in FIG. 5, the locking joint 5 may be a cylindrical structure. An outer surface of the locking joint 5 may be provided with a second external thread 21, which is connected with the first inner thread 18 of the upper cone 2. The locking joint 5 may be provided with a first inner hole 22 along an axial direction of the pull rod 9, and an inner surface of the first inner hole 22 may be provided with a second groove 23. When the upper cone 2 and the lower cone 6 generate a relative movement, the locking joint 5 may move forward along a second inner thread 44 of the lower cone 6 to securely lock positions of the upper cone 2 and the lower cone 6.

Figure 6:
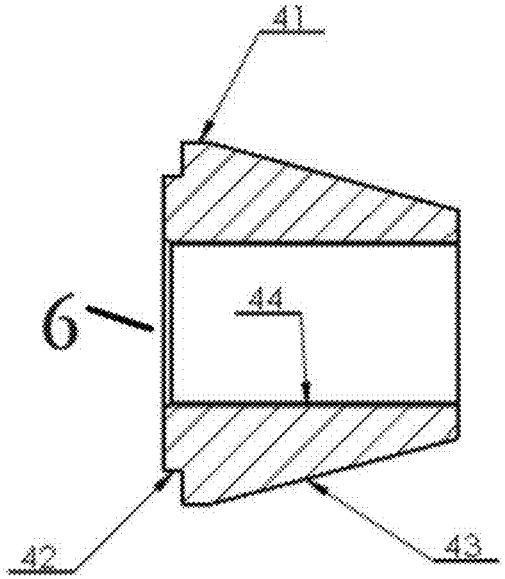
FIG. 6 is a schematic diagram illustrating an exemplary structure of lower cone according to some embodiments of the present disclosure.

FIG. 6 is a schematic diagram illustrating an exemplary structure of lower cone according to some embodiments of the present disclosure. As shown in FIG. 6, the lower cone 6 may be a cylindrical structure, and an outer surface of the lower cone 6 may be provided with a boss structure 42, a second outer cylindrical surface 41 and a second outer conical surface 43 sequentially from left to right along an axial direction of the pull rod 9. The boss structure 42 may abut against an end of the metal sealing ring 4 away from the locking cap 1, and the second outer conical surface 43 may be clamped within the slip spider 7. The lower cone 6 may be provided with a second inner hole along the axial direction of the pull rod 9, the second inner hole being provided with the second inner thread 44 on an inner surface of the second inner hole, the second inner thread 44 being connected with a second outer thread 21 of the locking joint 5.

The slip spider 7 refers to an element used to perform a bridge plug anchoring when the bridge plug is seated. As shown in FIG. 1, the slip spider 7 may be a cylindrical structure. An end of the slip spider 7 close to the locking cap 1 may be provided with a conical hole along the axial direction of the pull rod 9. The slip spider 7 may be sleeved on the second outer conical surface 43 of the lower cone 6, and an inner surface of the conical hole may be fitted to the second outer conical surface 43 of the lower cone 6. In some embodiments, the slip spider 7 may be provided with a plurality of grooves uniformly disposed in a circumferential direction along an outer surface of the slip spider 7 at an end away from the locking cap.

In some embodiments, a plurality of the anchor teeth 61 may be provided on the outer surface of the slip spider 7. The anchor teeth 61 may be teeth for inserting into an inner wall of a casing. The plurality of the anchor teeth 61 may have the same or different structural shapes and dimensions. In some embodiments, the plurality of the anchor teeth 61 may be dispersedly disposed on the outer surface of the slip spider 7, and there may be angles between axial directions of each the anchor teeth 61 and the outer surface of the slip spider 7, which may be less than 90°. When the bridge plug is seated and sealed, the lower cone 6 and the slip spider 7 may be in a relative movement, the lower cone 6 may move along the inner surface of the conical hole of the slip spider 7 toward an end away from the locking cap 1, and the slip spider 7 may expand radially along the second outer cone surface 43 of the lower cone 6. The anchoring of the bridge plug may be completed when the anchor teeth 61 are engaged into the inner wall of the casing at a certain depth.

It should be noted that an outer diameter of the slip spider 7 may or may not be the same as an outer diameter of the metal sealing ring 4, the present disclosure does not limit this.

Figure 7:
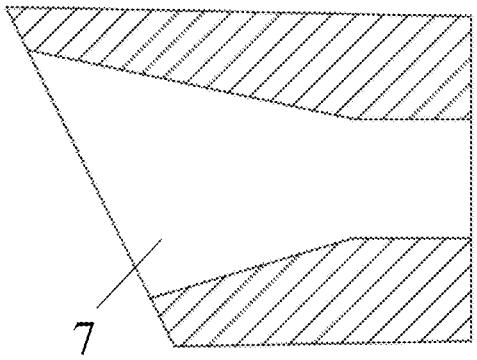
FIG. 7 is a schematic diagram illustrating an exemplary structure of a swallowtail structure according to some embodiments of the present disclosure.

FIG. 7 is a schematic diagram illustrating an exemplary structure of a swallowtail structure according to some embodiments of the present disclosure. As shown in FIG. 7, an end of the slip spider 7 close to the locking cap 1 may be designed as a swallowtail structure. The swallowtail structure refers to a structure with an oblique cross-section that is oval. The oblique cross-section may be understood as a plane obtained by taking a vertical plane as an initial plane and tilting by a certain angle based on the initial plane. By adopting the swallowtail structure, on the one hand, a metal content of the bridge plug as a whole may be reduced, thereby reducing a weight of the bridge plug; on the other hand, it may also be conducive to reducing an existence of a localized high stress region at a joint, and reducing a number of milling particles generated during a use of the bridge plug, thus slowing down the wear of the bridge plug and extending a service life thereof.

The base 8 refers to an element for limiting positions of other components sleeved on the pull rod 9 at the other end (a lower end) along the axial direction of the pull rod 9. The lower end may be understood as an end away from the seating tool, i.e., away from the locking cap 1. As shown in FIG. 1, the base 8 may be a cylindrical structure, and an end of the base 8 near the locking cap 1 may be provided with a boss, which engages a groove of the slip spider 7. The base 8 may be provided with a through hole along the axial direction of the pull rod 9, an inner surface of the through hole being provided with a third inner thread connected with a first outer thread of the pull rod 9. By connecting the third inner thread on the inner surface of the through hole of the base 8 to the first outer thread of the pull rod 9, the base 8 may be fixed to the pull rod 9, so that other components (e.g., such as the lower cone 6, the slip spider 7, etc.) sleeved on the pull rod 9 may be limited at the lower end of the pull rod 9 in the axial direction.

When the bridge plug is sealed, the base 8 and the pull rod 9 may remain motionless, and the upper cone 2, the metal sealing ring 4, the locking joint 5, and the lower cone 6 may move together to the end away from the locking cap. The slip spider 7 may expand radially along the second outer conical surface 43 of the lower cone 6, and when the anchor teeth 61 engage into an inner wall of the casing at a certain depth, an anchoring of the bridge plug may be completed. After the bridge plug is anchored, the lower cone 6 may still remain motionless, the upper cone 2 may continue to move away from the end of the locking cap 1, and the metal sealing ring 4 may climb upwardly along the first outer conical surface 17 of the upper cone 2, at which time an outer diameter of the metal sealing ring 4 expands radially. When the outer diameter of the metal sealing ring 4 expands to contact the inner wall of the casing, as the metal sealing ring 4 is a soft metal, the metal sealing ring 4 may be tightly fitted to the inner wall of the casing under an action of an seating sealing force of the bridge plug. The metal sealing ring 4 may fill an annular space between the inner wall of the casing and the first outer conical surface 17 of the upper cone 2, i.e., the metal sealing ring 4 may play a role of sealing. At the same time, the second outer thread 21 of the locking joint 5 may move along the second inner thread 44 of the lower cone 6 towards the end away from the locking cap 1, locking a relative position between the upper cone 2 and the lower cone 6, which completes the seating sealing of the bridge plug.

When the seating force of the bridge plug reaches a certain value, the thread connecting the base 8 and the pull rod 9 may be disengaged, and a cable may be lifted up, so that the seating tool, the locking cap 1, and the pull rod 9 may be raised out of an oil and gas well. At this time, a fracturing fluid may be pumped from a wellhead, and the sealing ball 3, under an action of the flow of the fluid, may be seated on the second inner conical hole 14 of the upper cone 2, and the sealing ball 3 may seal a center channel of the bridge plug, The upper and lower parts of the bridge plug may be blocked, i.e. forming a sealing effect of a fracturing in segments.

In some embodiments, the metal sealing ring 4 may climb upwardly along the first outer conical surface 17 of the upper cone 2, and the climbing position may vary with different sizes of expansions of the outer diameter of the metal sealing ring 4. The metal sealing rings 4 with different sizes may be able to produce the sealing effect on the casings with different inner diameters.

In some embodiments, the pull rods 9 and the locking cap 1 may be metallic, and after the bridge plug is seated, the pull rod 9 and the locking cap 1 may be raised out of the oil and gas well, and the other components may be dropped downhole. The components that are dropped downhole may be made of magnesium-based and aluminum-based dissolvable metallic materials, which dissolve automatically after fracturing is completed.

Figure 8:
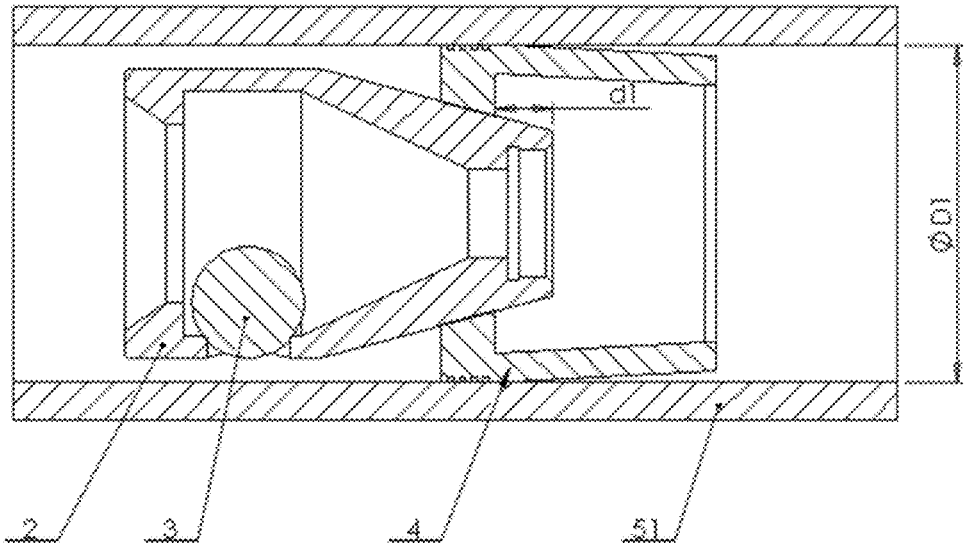
FIG. 8 is a schematic diagram illustrating a sealing inner diameter of one of casings with various specifications according to some embodiments of the present disclosure.
Figure 9:
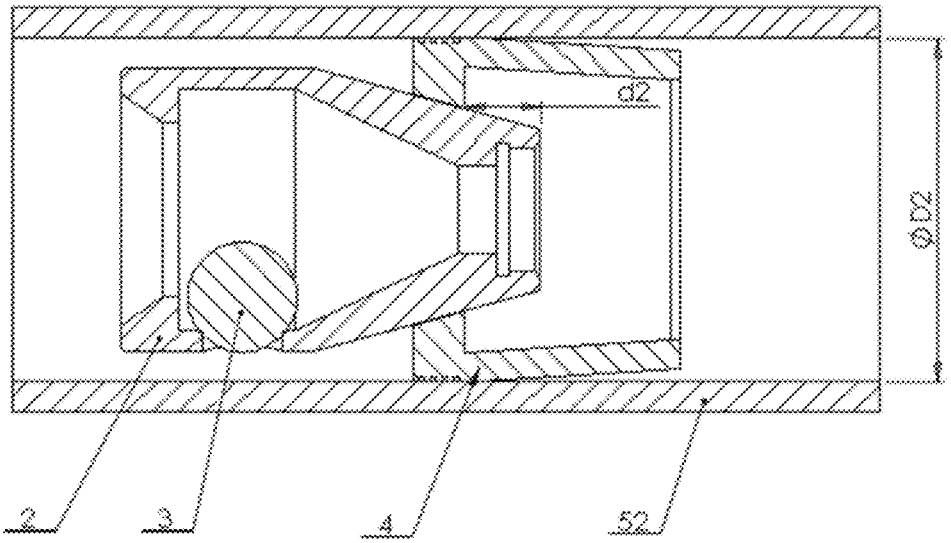
FIG. 9 is another schematic diagram illustrating a sealing inner diameter of one of casings with various specifications according to some embodiments of the present disclosure.
Figure 10:
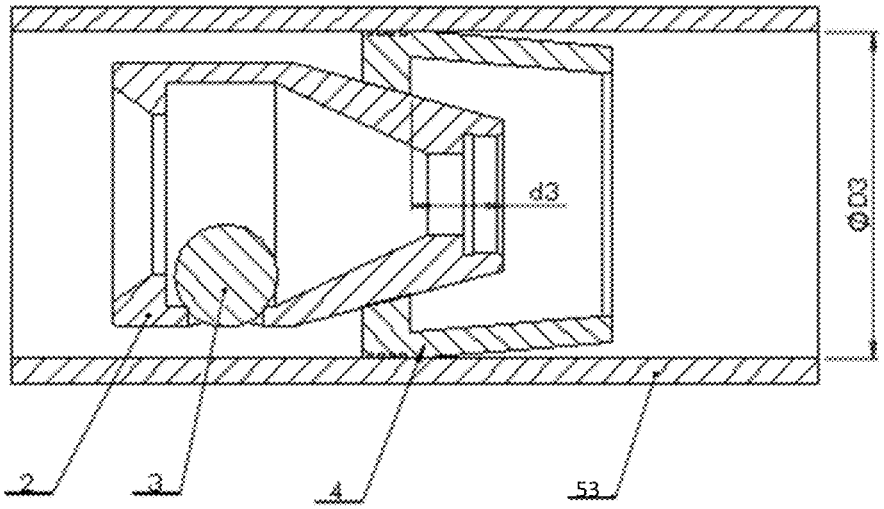
FIG. 10 is another schematic diagram illustrating a sealing inner diameter of one of casings with various specifications according to some embodiments of the present disclosure.

FIG. 8-FIG. 10 are schematic diagrams illustrating sealing inner diameters of casings with various specifications according to some embodiments of the present disclosure. As shown in FIG. 8-FIG. 10, a first casing 51, a second casing 52, and a third casing 53 may be three casings with different specifications whose inner diameters are D1, D2, and D3, respectively. When the metal sealing ring 4 climbs along the first outer conical surface 17 of the upper cone 2 to different positions (distances between an inner surface of a lower end of the metal sealing ring 4 and an end surface of the lower end of the upper cone 2, denoted by d1, d2, and d3, respectively), an outer diameter of the metal sealing ring 4 may expand to D1, D2, and D3, respectively.

Some embodiments of the present disclosure provide an all-metal bridge plug with a self-contained ball adapted to casings with various specifications. By a double-cone structure, the all-metal bridge plug separates the sealing and the anchoring, so that they do not interfere with each other, and a reliable performance is ensured. Through the different positions of the metal sealing ring 4 climbing up the surface of the upper cone 2, the sealing of the inner diameter of casings with various specifications may be achieved. By designing the sealing ball 3 inside the bridge plug, after the bridge plug is seated and sealed, a seating tool may be raised out of the oil and gas well and a pressure may be applied from the wellhead. The sealing ball 3 in the bridge plug may seal a center channel of the bridge plug under an action of a liquid flow, and the sealing of the bridge plug may be tested, thereby improving the reliability of the bridge plug, and saving time and material for pumping the ball from the wellhead.

In some embodiments, an outer surface of the lower cone 6 may be provided with a sensing device (not shown). The sensing device may be configured to detect distance data between the lower cone 6 and the slip spider 7.

The sensing device may be configured to measure a distance between two objects. For example, the sensing device may include, but not limited to, a photoelectric sensor, a lidar sensor, or the like.

The distance data between the lower cone 6 and the slip spider 7 may represent a distance between a setting position of the sensing device on the outer surface of the lower cone 6 and an upper end face of the slip spider 7. In some embodiments, the sensing device may be a photoelectric sensor, and the photoelectric sensor may emit a light beam (e.g., an infrared beam) to irradiate the upper end face of the slip spider 7. When the infrared beam is irradiated to the upper end face of the slip spider 7, a portion of the infrared beam may be reflected, and the photoelectric sensor may then, by receiving and detecting the reflected light signals, obtain the distance data between the lower cone 6 and the slip spider 7. An intensity of the reflected light signals may vary depending on the distance between the lower cone 6 and the slip spider 7. In some embodiments, the sensing device may collect, at a preset time interval, the distance data between the lower cone 6 and the slip spider 7. The preset time interval may be set manually. In some embodiments, the distance data may be a data sequence.

In some embodiments, an outer surface of the sensing device may be provided with a protective layer to seal the sensing device while ensuring that the sensing device is always insulated.

In some embodiments, the pull rod 9 may be connected with a driving device at an end near the locking cap 1. The driving device may be electrically connected with the sensing device and a control terminal. The driving device may be configured to provide a seating force. The control terminal may include a processor configured to: obtain the distance data between the lower cone 6 and the slip spider 7; determine, based on the distance data, an advance depth of the lower cone 6; determine, based on the advance depth of the lower cone 6, dimension data of the slip spider 7; and adjusting, based on the dimension data of the slip spider 7, a driving power of the driving device.

A driving device is a device that is capable of generating motion or transforming a form of motion. For example, a driving device may include a hydraulic driving device, a motor driving device, etc. In some embodiments, the driving device may be a component of the seating tool. In some embodiments, the driving device may be used to provide a seating force to move the upper cone 2, the metal sealing ring 4, the locking joint 5, and the lower cone 6 along the axial axis of the pull rod 9 toward an end away from the locking cap 1.

The control terminal refers to a terminal controller for controlling other apparatus or devices to perform a fracturing operation. An exemplary control terminal may include one of a console, a mobile device, a desktop computer, devices having input and/or output functions, or any combination thereof. In some embodiments, the control terminal may enable a bridge plug segmental fracturing by controlling one or more devices or apparatus. For example, the control terminal may control the driving device to provide the seating force to move a component, such as the upper cone 2, towards the end away from the locking cap 1, to achieve the bridge plug anchoring and seating. As another example, when the bridge plug seating is completed, the control terminal may control a cable retrieval device to uplift the cables to raise the seating tool, and lift the locking cap 1 and the pull rods 9 out of the oil and gas well.

The processor may process data and/or information obtained from other devices or apparatus. The processor may perform program instructions based on such data, information, and/or processing results to perform one or more of the functions described in the present disclosure. In some embodiments, the processor may include one or more sub-processing devices (e.g., a single-core processing device or a multi-core processing device). Merely by way of example, the processor may include a central processing unit (CPU), a controller, a microprocessor, or any combination thereof.

In some embodiments, the processor may directly obtain the distance data between the lower cone 6 and the slip spider 7 through the sensing device. More descriptions of the distance data between the lower cone 6 and the slip spider 7 may be found in the preceding descriptions.

The advance depth of the lower cone 6 refers to a distance of the lower cone 6 moving axially under the seating force of the pull rod 9 toward the end away from the locking cap 1 when the bridge plug is seated. In some embodiments, the processor may obtain the advance depth of the lower cone 6 based on the distance data between the lower cone 6 and the slip spider 7 by calculating a difference between the distance data before and after the time interval.

The dimension data of the slip spider 7 refers to data related to the dimension of the slip spider 7. In some embodiments, the dimension data of the slip spider 7 may include an outer diameter of the slip spider 7. The outer diameter of the slip spider 7 may be a diameter at the upper end of the slip spider 7.

The processor may determine the dimension data of the slip spider 7 in a variety of ways based on the advance depth of the lower cone 6. In some embodiments, the processor may determine the dimension data of the slip spider 7 through a preset relationship table. The preset relationship table may represent a correlation between the dimension data of the slip spider 7 and the advance depth of the lower cone 6. For each advance depth of the lower cone 6, there may be the dimension data for the corresponding slip spider 7. In some embodiments, the preset relationship table may be constructed based on a historical advance depth of the lower cone 6 and historical dimension data of the slip spider 7.

The driving power of the drive unit refers to an output power when the driving device is running. The seating force provided by the driving device may be positively correlated with the drive power of the driving device. The greater the drive power, the greater the seating force provided by the driving device.

The processor may adjust the driving power of the driving device in a variety of ways based on the dimension data of the slip spider 7. In some embodiments, the processor may determine, based on the dimension data of the slip spider 7, whether or not the dimension data of the slip spider 7 satisfies a preset condition, and in response to the dimension data of the slip spider 7 satisfying the preset condition, the processor may determine an adjustment magnitude, and downwardly adjust the driving power of the driving device based on the adjustment magnitude. The preset condition may include that the dimension data of the slip spider 7 is not less than a preset threshold value, or the like. In some embodiments, the preset threshold may be determined based on the inner diameter of the casing, and the preset threshold may be greater than the inner diameter of the casing. The adjustment magnitude refers to a magnitude for adjusting the driving power of the driving device. In some embodiments, the adjustment magnitude may be determined through a weighted summation, based on, for example, a first difference between the outer diameter of the slip spider 7 and a preset threshold value, and a second difference between the outer diameter of the upper cone 2 and the outer diameter of the slip spider 7. The greater the differences, the greater the corresponding weight.

In some embodiments of the present disclosure, by monitoring the advance depth of the lower cone 6 and thereby monitoring the dimension data of the slip spider 7, it may be ensured that the bridge plug is anchored in casings with various specifications. When the dimensional data (e.g., the outer diameter) of the slip spider 7 reaches the preset threshold, i.e., the bridge plug is anchored, the seating force provided by the driving device may be properly reduced to ensure that the upper cone 2 and other elements continue to move along the axial direction of the pull rods 9 toward the end away from the locking cap 1, so that the metal sealing ring 4 climbs upwardly along the first outer conical surface 17 of the upper cone 2 until the metal sealing ring 4 comes into contact with the inner wall of the casing. This enables a seal between the inner wall of the casing and the first outer conical surface 17 of the upper cone 2. At the same time, it may also be conducive to energy saving and cost saving.

The basic concepts have been described above, and it may be apparent to those skilled in the art that the foregoing detailed disclosure serves only as an example and does not constitute a limitation of the present disclosure. While not expressly stated herein, various modifications, improvements, and amendments may be made to the present disclosure by those skilled in the art. Such types of modifications, improvements, and amendments are suggested in the present disclosure, and therefore remain within the spirit and scope of the exemplary embodiments of the present disclosure.

What is claimed is:

1. An all-metal bridge plug with a sealing ball adapted to casings with various specifications, comprising a pull rod; wherein an upper end of the pull rod is connected with a seating tool, and a locking cap is connected with an upper end of the pull rod through a thread, a lower end of the pull rod is connected with a base through the thread; and an upper cone, the sealing ball, a metal sealing ring, a locking joint, a lower cone, a slip spider, and the base are manufactured from magnesium-based and aluminum-based dissolvable metal materials that dissolve automatically after fracture is completed;

the pull rod is located in an axial axis, and the locking cap, the upper cone, the metal sealing ring, the locking joint, the lower cone, and the slip spider are sleeved on the pull rod sequentially from left to right along an axial direction of the pull rod;

the upper cone is a cylindrical structure that includes an upper end portion and a lower end portion, wherein an outer surface of the upper end portion is an outer cylindrical surface, the upper end portion is provided with a first inner conical hole, a first inner circular hole, and a second inner circular hole sequentially inside; a circular hole structure is provided between the outer cylindrical surface and the inner circular hole for placing the sealing ball, a size of the circular hole structure being smaller than a size of the sealing ball; an outer surface of the lower end portion is an outer conical surface, and the lower end portion is provided with a second inner conical hole, a third inner circular hole, and an inner thread sequentially inside; the first inner conical hole is sleeved on the locking cap;

the metal sealing ring is a cylindrical structure whose outer surface is a cylindrical surface, wherein an upper end inner hole is an inner conical surface sleeved on the outer conical surface of the upper cone, the inner conical surface and the first outer conical surface having a same cone angle and are fitted with each other; an upper outer cylindrical surface is provided with a plurality of first grooves, and a lower end inner portion is a circular hole;

the locking joint is a cylindrical structure whose outer surface is provided with an outer thread, there is a broken groove between the outer surface and the inner hole, and an upper end portion of the outer thread is connected with the lower end portion of the upper cone;

the lower cone is a cylindrical structure whose outer side is provided with a boss structure on the upper end portion, an outer cylindrical surface, and a conical surface on the lower end sequentially; the boss structure is abutted against the lower end portion of the metal sealing ring, and the outer conical surface is clamped within the slip spider; an upper inner hole is provided with the thread, which is connected with the thread at the lower end of the outer thread of the locking joint;

the slip spider is a cylindrical structure whose upper end inner portion is a conical hole, the slip spider is sleeved on the outer conical surface of the lower cone, and the conical hole is fitted to the conical surface of the lower cone; the slip spider is provided with a plurality of incisions uniformly disposed in a circumferential direction, and a plurality of grooves are provided on the lower end surface of the slip spider; and the base is a cylindrical structure provided with the threads on the inner surface, the upper end surface is provided with the bosses whose count is the same with a count of the grooves on the lower end surface of the slip spider, and the thread on the inner surface is connected with the thread on the lower end of the pull rod.

* * * * *